United States Patent [19]

Kazaoka et al.

[11] Patent Number: 5,051,070

[45] Date of Patent: Sep. 24, 1991

[54] VARIABLE CAPACITY COMPRESSOR

[75] Inventors: Kenichi Kazaoka, Nagoya; Hiroshi Okazaki, Kariya, both of Japan

[73] Assignee: Aisin Seiki Kabushiki Kaisha, Kariya, Japan

[21] Appl. No.: 459,378

[22] Filed: Dec. 29, 1989

[30] Foreign Application Priority Data

Dec. 29, 1988 [JP] Japan ..... 53-331387
Dec. 29, 1988 [JP] Japan ..... 53-331389

[51] Int. Cl.[5] ..... F04B 49/00; F04C 18/00

[52] U.S. Cl. ..... 417/295; 417/283; 417/310; 418/61.1

[58] Field of Search ..... 417/283, 310, 295; 418/61.1

[56] References Cited

U.S. PATENT DOCUMENTS

| | | | |
|---|---|---|---|
| 4,428,718 | 1/1984 | Skinner | 417/222.5 |
| 4,692,104 | 9/1987 | Hansen | 418/61.1 |
| 4,808,083 | 2/1989 | Watanabe | 417/310 |
| 4,859,154 | 8/1989 | Aihara | 417/310 |
| 4,890,985 | 1/1990 | Sugiura | 417/295 |

*Primary Examiner*—Leonard E. Smith
*Assistant Examiner*—Alfred Basichas
*Attorney, Agent, or Firm*—Burns, Doane, Swecker & Mathis

[57] ABSTRACT

A compressor suitable for use in a vehicle cooling system. The compressor includes a cylinder having a cylindrical inner wall surface, a rotor supported by a crankshaft having an eccentric portion in the cylinder. A pair of vanes are carried at diametrically opposed positions by the rotor to extend in a radial direction, each of the vanes having a radially outward edge which is in sliding contact with the inner wall surface of the cylinder. End plates are secured to the cylinder at the axially opposite ends of the cylinder. A link mechanism is provided between the rotor and at least one of the end plates so that the rotor conducts a reciprocating angular movement in an angular range in response to a rotation of the crankshaft. The inner wall surface of the cylinder, the vanes and the end plates define working chambers of which volumes are variable in response to the angular movement of the rotor. An auxilliary plate is provided at an axially inner side of one of the end plates and having bypass ports for bridging the working chambers at the opposite sides of the vane when the vane moves on the bypass ports, an actuating mechanism for rotating the auxilliary plate with respect to the cylinder for changing cicumferential position of the bypass ports with respect to the angular range of the angular movement of the rotor so that the effective stroke of the compressor is changed.

8 Claims, 26 Drawing Sheets

VARIABLE CAPACITY COMPRESSOR

BACKGROUND OF THE INVENTION

1. Field of the Invention

The present invention relates to a compressor, and more particularly to a compressor suitable for use in a cooling system. More specifically, the present invention pertains to a rotary type compressor having a rotor eccentrically disposed in a cylinder.

2. Description of the Prior Art

A air cooling system for a vehicle includes a compressor for compressing cooling medium such as freon gas and send the compressed medium to a condenser. Compressors conventionally used for the purpose includes those of an axial piston type and of a rotary type. Those compressors are generally driven by means of power plants, however, conventional compressors are not satisfactory in respect of energy consumption. Further, the compressors used in such cooling systems are of a fixed capacity so that several inconveniencies have been experienced. For example, in the case where a rapid cooling down is desired, it is necessary to decrease the air flow through the evaporator so that the temperature which has passed through the evaporator is decreased. However, such control is not desirable because time is required to obtain a desired temperature. It should further be noted that the compressor is operated constantly even after a desired temperature has been obtained so that unnecessary energy is consumed.

SUMMARY OF THE INVENTION

It is therefore an object of the present invention to provide a compressor of a variable capacity which is suitable for use in a cooling system.

Another object of the present invention is to provide a rotary type compressor having simple means for varying capacity.

Further object of the present invention is to provide a variable capacity rotary compressor in which the capacity of the compressor can be changed in accordance with a pressure produced in the compressor.

According to the present invention, the above and other objects can be accomplished by a compressor including a cylinder having cylindrical inner wall surface, a rotor supported by eccentric means in said cylinder, at least a pair of vanes carried at diametrically opposed positions by said rotor to extend in a radial direction, each of said vanes having a radially outward edge which is in sliding contact with said inner wall surface of said cylinder, end plates secured to said cylinder at the axially opposite ends of the cylinder, said inner wall surface of the cylinder, said vanes and said end plates defining working chambers of which volumes being variable in response to a rotating movement of the rotor, inlet and outlet port means for said working chambers, auxilliary bypass port means provided on an axially inner side of at least one of said end plates for bridging the working chambers at the opposite sides of the vane when the vane moves on the bypass port means, stroke changing means for changing cicumferential position of the bypass port means so that the effective stroke of the compressor is changed.

The bypass port means may be provided on an auxilliary plate which is located on an axially inner side of one of the end plates and angularly displaceable about an axis of the cylinder. The auxilliary plate may be actuated to a desired angular position by means of an actuator which is operated by the outlet pressure or other pressure of the compressor.

In an alternative structure, the bypass port means is provided on the inner wall surface of the cylinder and the angular range of the operation of the vanes can be changed by angularly displacing the auxilliary plate.

The above and other objects and features of the present invention will become apparent from the following description of preferred embodiments taking reference to the accompanying drawings.

DESCRIPTION OF THE PREFERRED EMBODIMENT

Figure 1:
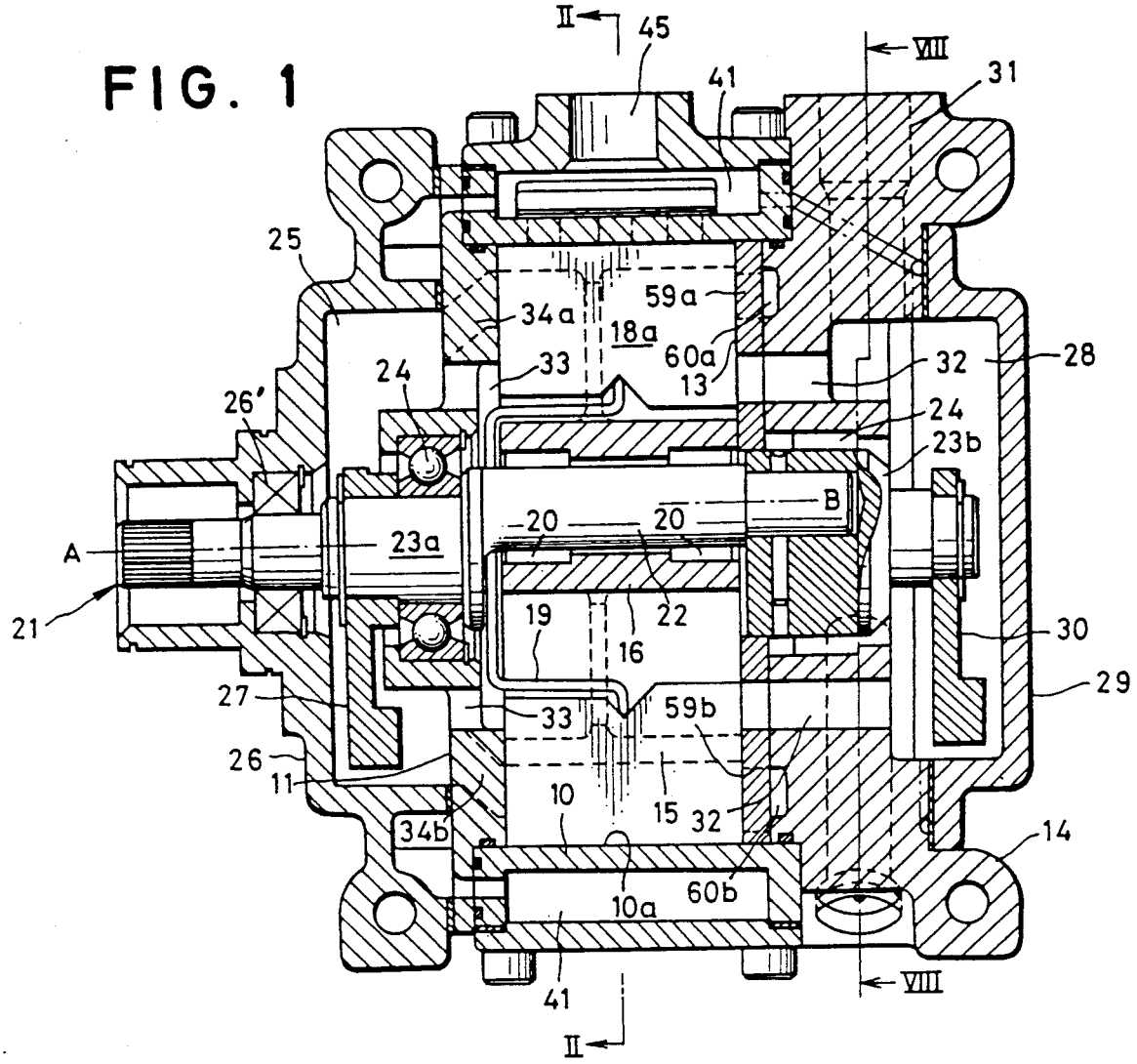
FIG. 1 is a longitudinal sectional view of a compressor in accordance with one embodiment of the present invention.

Referring to the drawings, particularly to FIG. 1, there is shown a compressor including a cylinder 10 having a cylindrical inner wall surface 10*a*. A front end plate 11 is secured to one axial end of the cylinder 10 by means of bolts 12 with sealing members intervened between the cylinder 10 and the end plate 11. A rear end plate 14 is attached to the other axial end of the cylinder by means of bolts which are not shown with sealing members intervened between the end plate and the cylinder 10. A rear auxilliary plate 13 is provided on the axially inner side of the rear end plate 14. The rear auxilliary plate 13 is in sliding contact at the peripheral edge with the inner wall surface 10*a* of the cylinder 10 and at the axially outer side with the rear end plate 14.

Figure 2:
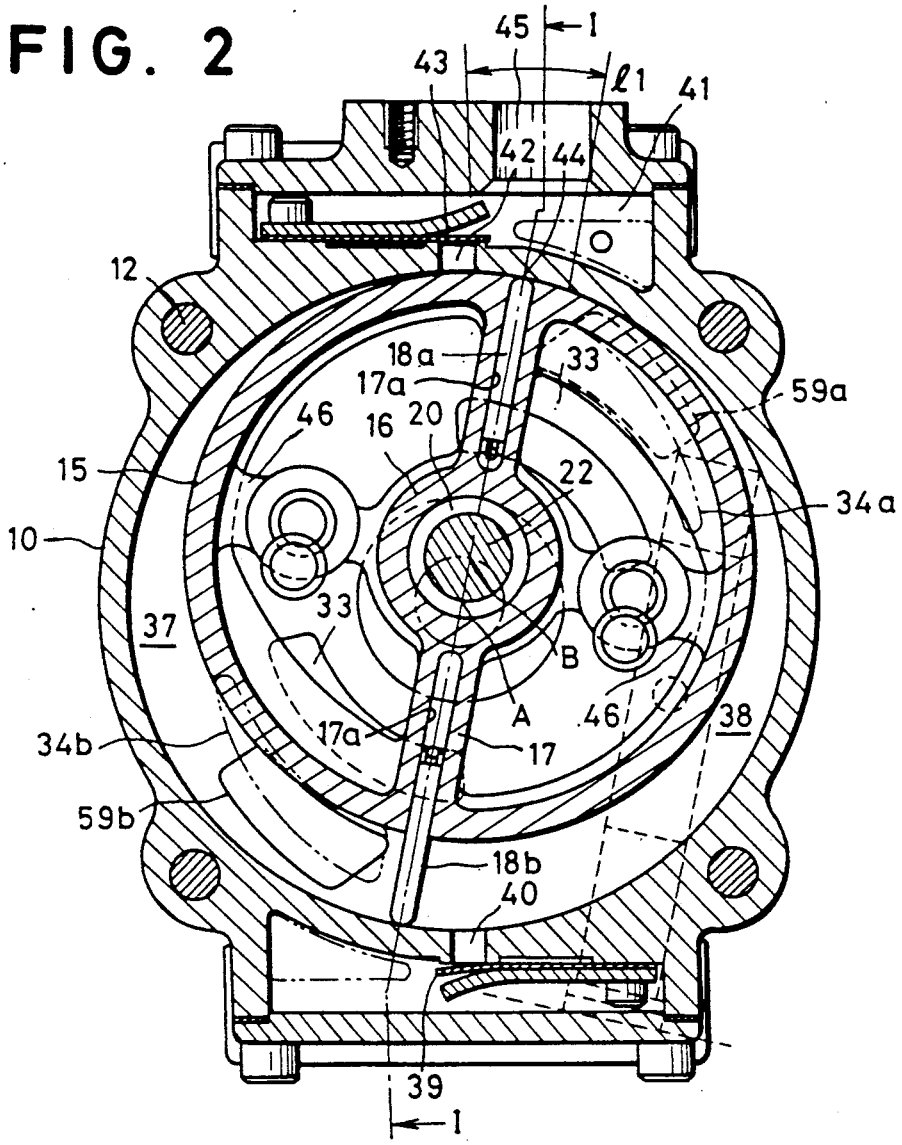
FIG. 2 is a cross-sectional view of the compressor taken along the line II—II in FIG. 1.

In the cylinder 10, there is provided a rotor 15 of a cylindrical configuration. The rotor 15 includes a hub 16 as shown in FIG. 2. The hub 16 is connected with the cylinder 15 by means of a pair of diametrically opposed ribs 17 and a further pair of diametrically opposed ribs 46. The first pair of ribs 17 are formed with diametrically extending slits 17*a* which slidably receive vanes 18*a* and 18*b*. Referring to FIG. 1, it will be noted that the vanes 18 are engaged with springs 19 which are provided in the cylinder 10 to force the vanes 18*a* and 18*b* radially outwards so that the radially outward edges of the vanes 18*a* and 18*b* are maintained in sliding contact with the inner wall surface 10*a* of the cylinder 10.

A crankshaft 21 is provided in the cylinder 10. The crankshaft 21 includes an eccentric shaft portion 22 and a pair of coaxial end portions 23*a* and 23*b*. The end portion 23*a* is carried by the front end plate 11 through a bearing 24 and the end portion 23*b* is carried by the rear end plate 14 by means of a bearing 24. The eccentric shaft portion 22 carries the hub 16 of the rotor 15 through bearings 20. It will therefore be understood that the rotor 15 is supported eccentrically in the cylinder 10 with one circumferential portion of the rotor 15 in contact with the inner wall surface 10*a* of the cylinder 10 as shown in FIG. 2. The vanes 18*a* and 18*b* divides the space between the cylinder 10 and the rotor 15 into working chambers 37 and 38.

Referring to FIG. 1, it will be noted that a front end cover 26 is attached to the front end plate 11 and a chamber 25 is defined between the front end plate 11 and the front end cover 26. The end portion 23*a* of the eccentric shaft 21 is passed through the front end cover 26 and a seal 26' is provided between the shaft portion 23*a* and the front end cover 26. The shaft portion 23*a* carries a front balancing weight 27 which is located in the chamber 25.

A rear end cover 29 is attached to the rear end plate 14 to provide a chamber 28 between the rear end plate 14 and the rear end cover 29. The shaft portion 23*b* is located in the chamber 28 and carries a rear balancing weight 30.

The rear end plate 14 is formed with an inlet passage 31 which is opened from the exterior of the compressor to the chamber 28. The rear end plate 14 is further formed with axial passages 32 which extend through the auxilliary plate 13 to connect the chamber 28 to the interior of the cylinder 10. The front end plate 11 is formed with axial passages 33 connecting the chamber 25 to the interior of the cylinder 10 at a diametrically inner portion. The front end plate 11 is further formed with inlet ports 34*a* and 34*b* which connect the chamber 25 to the interior of the cylinder 10 at diametrically outer portions. The rotor 15 is of a hollow cylindrical configuration and the interior space of the rotor 15 is in communication with the passages 32 formed in the rear end plate 14 and the passages 33 formed in the front end plate 11. It will therefore be understood that the chamber 28 defined between the rear end plate 14 and the rear end cover 29 is connected with the chamber 25 defined between the front end plate 11 and the front end cover 26 through the passages 32, the interior space of the rotor 15 and the passages 33.

In the position of the rotor 15 shown in FIG. 2, the inlet port 34*a* is covered by the rotor 15 so that the port 34*a* is not opened to the working chamber 38. However, the inlet port 34*b* is in a position opened to the working chamber 37 so that the gas or cooling medium introduced through the inlet passage 31 into the chamber 28 can be drawn through the passages 32, the interior space of the rotor 15 and the passages 33 into the chamber 25 and then from the chamber 25 into the working chamber 37.

Figure 6:
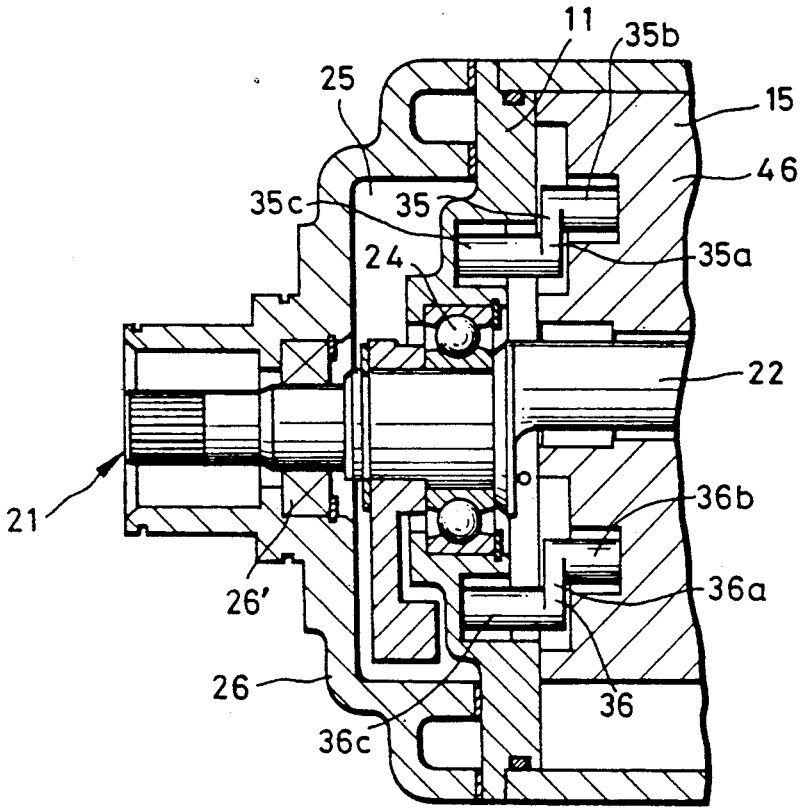
FIG. 6 is a fragmentary sectional view taken along the line VI—VI in FIG. 3 and showing the link mechanism for producing oscillatory movements of the rotor.

Referring now to FIG. 6, it will be noted that a pair of links 35 and 36 are provided between the rotor 15 and the front end plate 11. The link 35 has an arm portion 35*a* and a pair of axially extending end portions 35*b* and 35*c* which are extending in the axial direction from the opposite ends of the arm portion 35*a*. The end portion 35*b* is engaged with a recess formed in the adjacent end face of each of the ribs 46 formed in the rotor 15 whereas the end portion 35*c* is engaged with a recess formed in the front end plate 11. The link 36 similarly has an arm portion 36*a* and a pair of end portions 36*b* and 36*c*. The end portion 36*b* is engaged with a recess formed in the adjacent end face of the rotor 15 and the end portion 36*c* is engaged with a recess formed in the front end plate 11. The arm portions 35*a* and 36*a* extend in parallel with each other and with the direction of offset of the eccentric portion 22 of the crankshaft with respect to the end shaft portions 23*a* and 23*b*. Further, the arms 35*a* and 36*a* have effective lengths which are the same as the length of offset A-B of the eccentric portion 22 of the crankshaft 21 with respect to the end portions 23*a* and 23*b*. It will therefore be understood that the links 35 and 36 form together with the crankshaft 21 a parallelogram so that a rotation of the crankshaft 21 will produce an oscillatory movement of the rotor 15 within the angular range shown by $l_1$ in FIG. 2.

As shown in FIG. 2, the cylinder 10 is formed at a circumferential position with an outlet port 40 which is provided with a non-return check valve 39. At a portion diametrically opposite to the outlet port 40, there is formed a second outlet port 42 which is provided with a non-return check valve 43. The outlet ports 40 and 42 are opened to an outlet chamber 41 which leads to an outlet passage 45.

Referring now to FIGS. 2 through 5, when the crankshaft 21 is driven by a power plant to rotate clockwise, the rotor 15 is oscillated clockwise from the position shown in FIG. 2. The movement of the rotor 15 causes an increase in the volume of the working chamber 37 and a decrease in the volume of the working chamber 38. Since the inlet port 34*a* is closed by the rotor 15, the air in the working chamber 38 is compressed. The compressed air in the working chamber 38 is discharged to the outlet chamber 41 through the check valve 39. The working chamber 37 is opened to the inlet port 34*b* so that the external gas or cooling medium is drawn from the inlet passage 31 through the chamber 28, the passages 32, the interior space of the rotor 15, the passages 33, the chamber 25 and the inlet port 34*b* into the working chamber 37.

Figure 3:
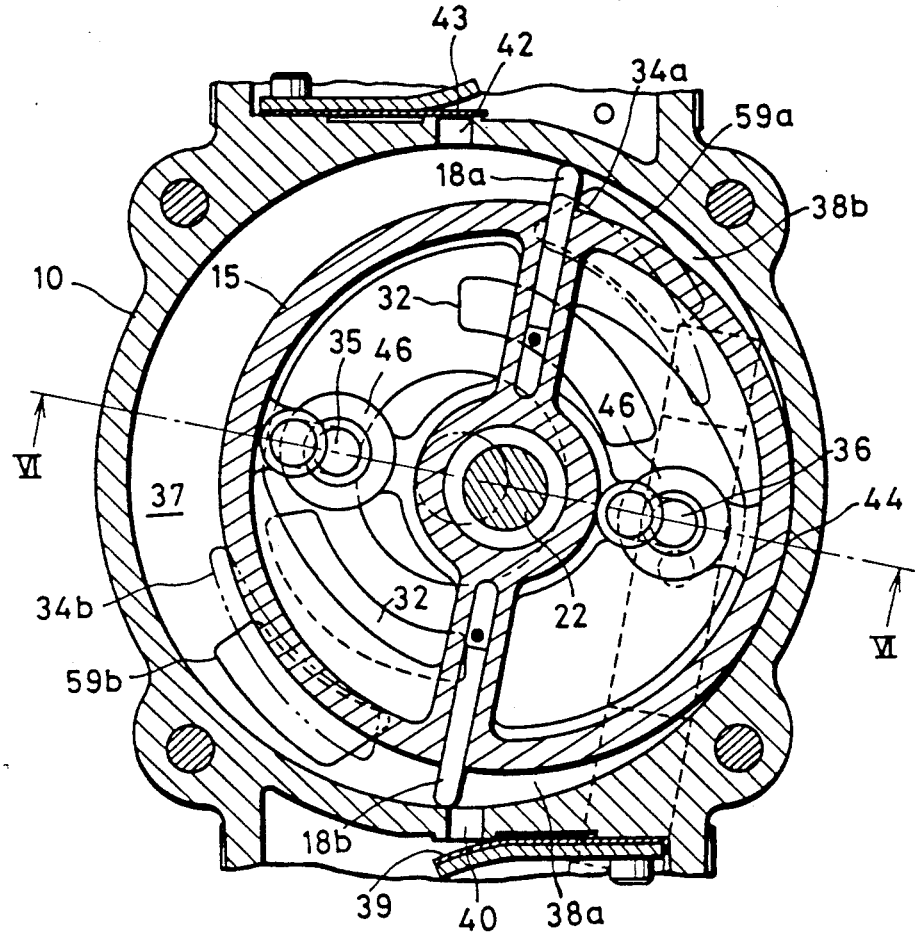
FIGS. 3 to 5 are sectional views similar to FIG. 2 but showing the rotor in different positions.

As the crankshaft 21 rotates, the point of contact of the rotor 15 with the inner wall surface 10*a* of the cylinder 10 is shifted clockwise from the position shown in FIG. 2 to the position shown in FIG. 3. In the position shown in FIG. 3, the working chamber 37 possesses the maximum volume and the intake stroke of the chamber 37 is at the end.

The point of contact of the rotor 15 with the inner wall surface 10*a* of the cylinder 10 is in the mid-point of the working chamber 38 in the position of the rotor 15 shown in FIG. 3. Thus, the chamber 38 is divided into subchambers 38*a* and 38*b*. In this position, the chamber 38 is still in the stage of the compression stroke so that the gas in the sub-chamber 38*a* is discharged through the outlet port 40 and the check valve 39 to the outlet chamber 41. The subchamber 38*b* is being increased in volume in this stage of operation and the sub-chamber 38*b* is opened to the inlet port 34*a*. Therefore, gas or the cooling medium is drawn into the sub-chamber 38*b* through the inlet port 34*a*.

In the stage of movement of the rotor 15 from the position shown in FIG. 2 to the position shown in FIG. 3, the vane 18*a* is moved toward the inlet port 34*a* and the vane 18*b* is moved toward the outlet port 40. The working chamber 37 is therefore increased in volume as previously described. The amount of movement of the rotor 15 is however small and the radial movements of the vanes 18*a* and 18*b* are therefore small. The arrangement is considered advantageous in that the inertia force of the vanes 18*a* and 18*b* can be maintained small even when the crankshaft 21 is rotated at a high speed. In the position shown in FIG. 3, the vane 18*a* is close to an end of the inlet port 34*a* and the vane 18*b* is close to an edge of the outlet port 40.

Figure 4:
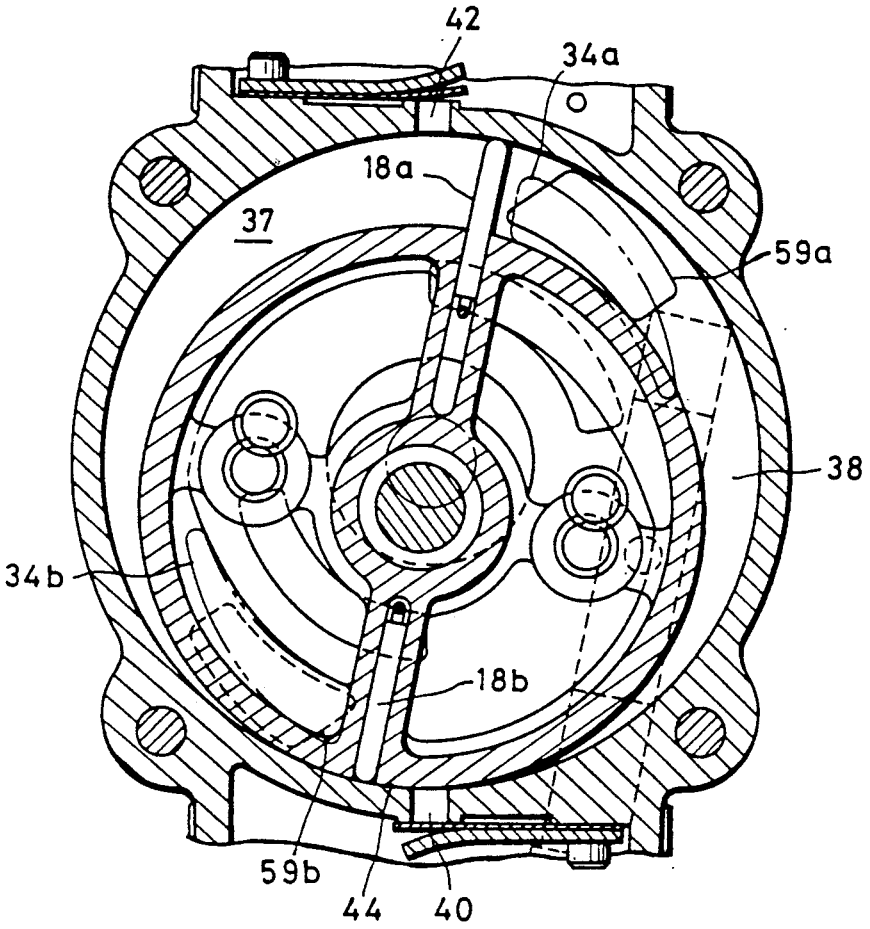

As the crankshaft 21 further rotates clockwise, the point of contact between the rotor 15 and the inner wall surface 10*a* of the cylinder 10 is shifted clockwise from the position shown in FIG. 3 to the position shown in FIG. 4. In the position shown in FIG. 4, the volume of the working chamber 37 is decreased from the volume in the position shown in FIG. 3. The working chamber 37 is opened to the outlet port 42. Therefore, in this course of operation, the gas in the working chamber 37 is compressed and discharged through the outlet port 42 and the check valve 43. In this stage of operation, the working chamber 38 is being increased in volume so that gas is being drawn into the chamber 38 through the inlet port 34*a*.

In the stage of movement of the rotor 15 from the position shown in FIG. 3 to the position shown in FIG. 4, the vane 18*a* moves toward the inlet port 34*b* and the vane 18*b* moves toward the outlet port 40. The volume of the chamber 37 is being decreased and the volume of the chamber 38 is being increased. The movements of the vanes 18*a* and 18*b* can be maintained small so that the inertia force of the vanes is small.

Figure 5:
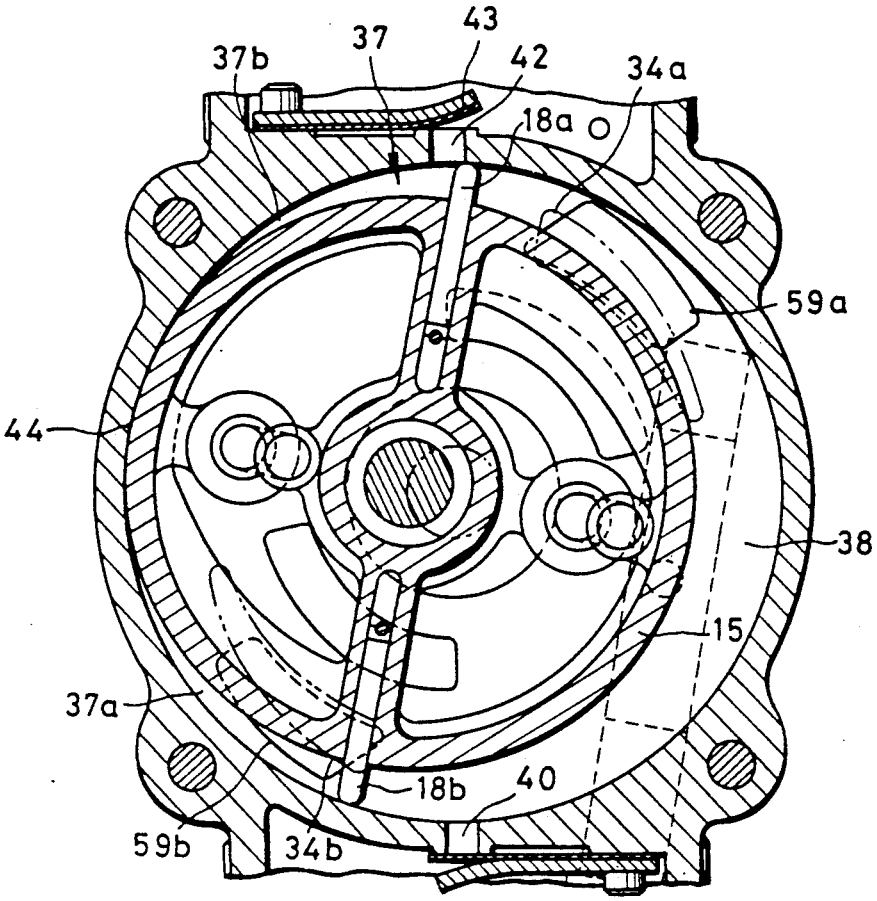

As the crankshaft 21 further continues to rotate clockwise, the point of contact of the rotor 15 with the inner wall surface 10*a* of the cylinder 10 is shifted clockwise from the position shown in FIG. 4 to the position shown in FIG. 5. In the position of the rotor 15 shown in FIG. 5, the point of contact of the rotor 15 with the inner wall surface 10*a* of the cylinder 10 in the working chamber 37. Thus, the chamber 37 is divided into two sub-chambers 37*a* and 37*b*. The sub-chamber 37*b* is being decreased in volume so that the gas in the sub-chamber 37*b* is being discharged through the outlet port 42 and the check valve 43. The volume of the sub-chamber 37*a* is being increased so that gas is being drawn into the sub-chamber 37*a* through the inlet port 34*b*.

In the position shown in FIG. 5, the working chamber 38 possesses the maximum volume. Therefore, the chamber 38 is at the end of the intake stroke. In the stage of movement of the rotor 15 from the position shown in FIG. 4 to the position shown in FIG. 5, the vane 18*a* moves gradually toward the inlet port 34*b* and the vane 18*b* moves gradually toward the outlet port 42. The volume of the working chamber 38 is gradually increased. The movements of the vanes 18*a* and 18*b* are small so that the inertia of the vanes is also small. The vanes 18*a* and 18*b* are moved to positions close to the edges of the ports 34*b* and 42.

Figure 7:
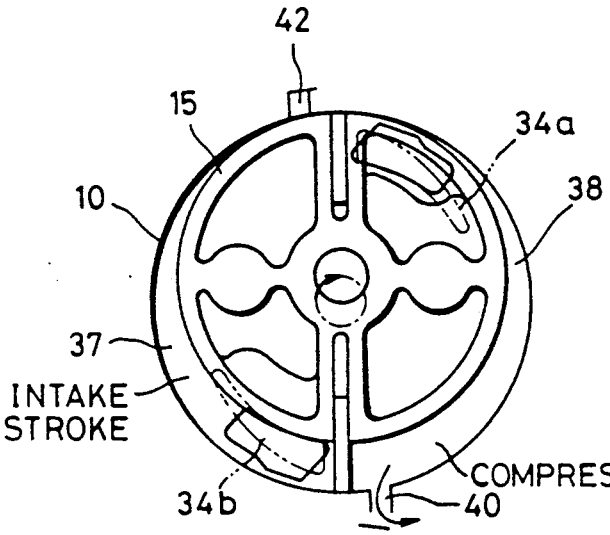
FIGS. 7 (*a*), (*b*), (*c*) and (*d*) are diagrammatical illustrations showing the operation of the compressore.
Figure 7:
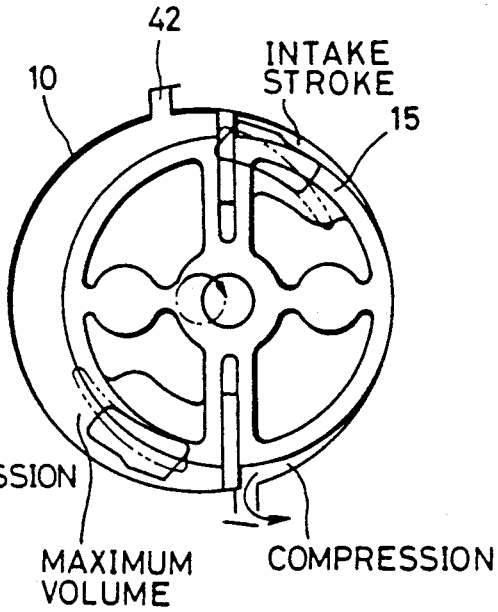
Figure 7:
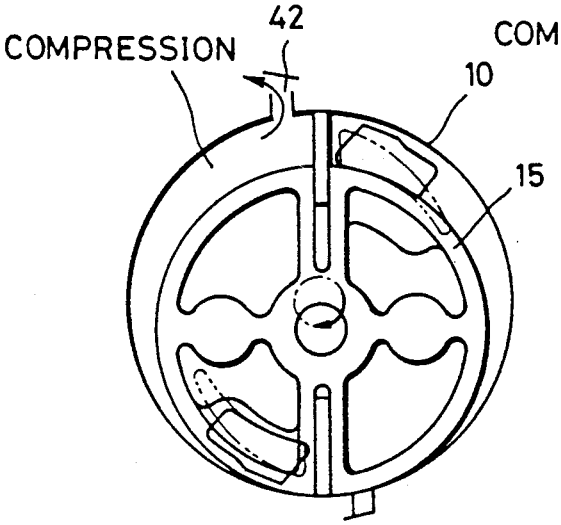
Figure 7:
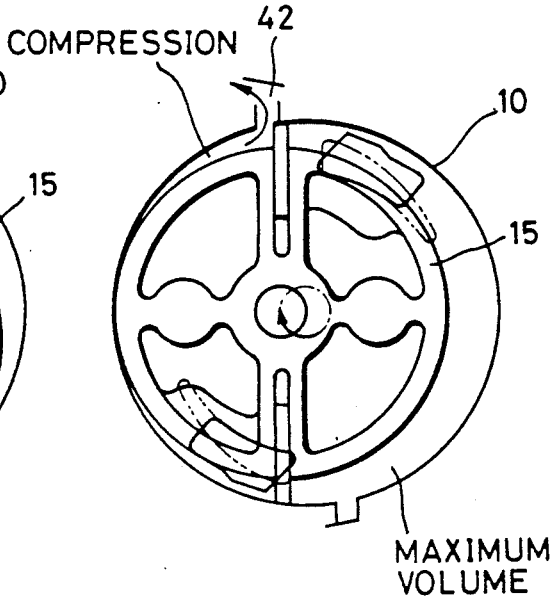

By repeating the operations described with reference to FIGS. 2 through 5, the compressor functions to draw low pressure gas from the inlet passage 31 and to discharge compressed high pressure gas from the outlet passage 45. The movement of the rotor 15 with respect to the cylinder 10 is shown in FIGS. 7 (*a*), (*b*), (*c*) and (*d*) which respectively correspond to FIGS. 2, 3, 4 and 5. It should be understood that FIG. 7 shows the operation of the compressor under 100% capacity.

When it is desired to cool the passsenger compartment rapidly, the compressor must be operated under a higher load. If the inlet gas to the compressor is increased to accommodate for the increased load, there will be a sudden decrease in the pressure in the evaporator. Thus, the temperature in the evaporator will accordingly be decreased. This may however not be desirable because there will be produced a problem of icing on fins in the evaporator. This problem may be avoided by using an evaporator and a compressor of a large capacity. The present invention solves the problem by providing a compressor of a variable capacity.

Figure 8:
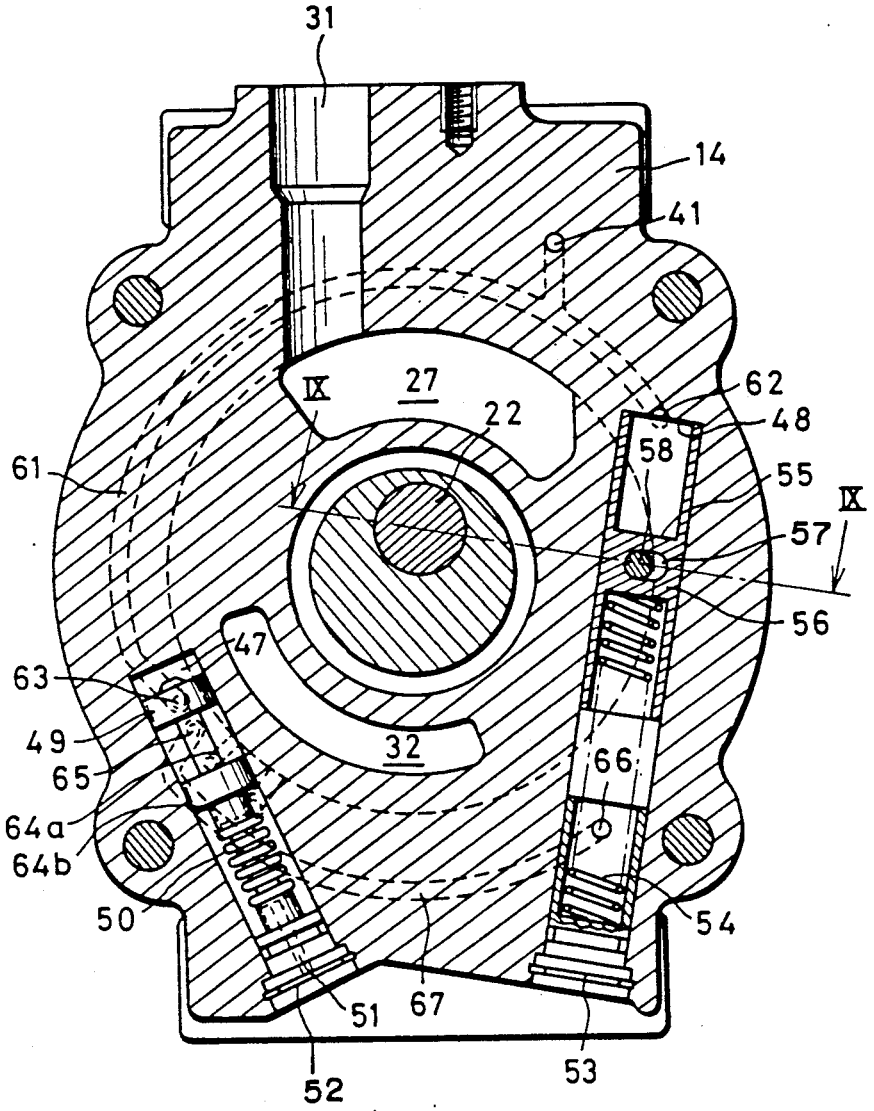
FIG. 8 is a sectional view taken along the line VIII—VIII in FIG. 1 and showing the mechanism for actuating the auxilliary plate.
Figure 9:
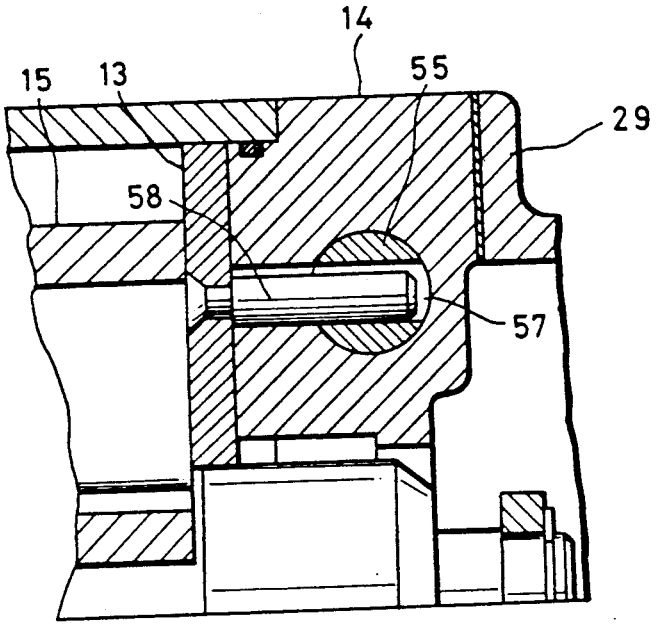
FIG. 9 is a fragmentary sectional view taken along the line IX—IX in FIG. 8.

Referring to FIG. 8, it will be noted that the rear end plate 14 is formed with a pair of cylindrical bores 47 and 48. In the bore 47, there is a valve spool 49 which is formed with a pair of axially spaced lands. The bore 47 is closed at one end and the other end of the bore 47 is capped by a plug 52 having a vent hole 51. Between the plug 52 and the valve spool 49, there is a bellows 50. The interior space of the bellows 50 is connected with the vent hole 51 in the plug 52 so that atmospheric pressure is introduced into the bellows 50. The bellows 50 has one end which is in an abutting engagement with one end of the valve spool 49.

In the bore 48, there is provided a plate driving piston 55 which is of a cylindrical configuration. The piston 55 is formed with a bridge 56 having a slot 57 which is engaged with a pin 58 provided on the auxilliary plate 13. It will therefore be understood that an axial movement of the driving piston 55 causes a rotation of the auxilliary plate 13 with respect to the rotor 15. The bore 48 is closed at one end and the open end is capped by a plug 53. Between the plug 53 and the driving piston 55, there is provided a compression spring 54 which functions to force the driving piston 55 upwards as seen in the plane of FIG. 8. It will be noted in FIG. 8 that the action of the spring 54 forces the auxilliary plate 13 in the counterclockwise direction.

Referring to FIG. 1, it will be noted that the auxilliary plate 13 is formed with a pair of bypass ports 59*a* and 59*b*. The rear end plate 14 is formed with grooves 60*a* and 60*b* at positions corresponding to the bypass ports 59*a* and 59*b*, respectively. The purpose of the grooves 60*a* and 60*b* is to provide bypass passages of increased crosssectional area together with the bypass ports 59*a* and 59*b*.

Referring again to FIG. 8, the rear end plate 14 is formed with a compressed gas passage 61 which is communicated with the outlet chamber 41. The compressed gas passage 61 is opened at one end to the bore 48 at the closed end thereof so that compressed gas pressure functions to force the driving piston 55 in the direction opposite to the action of the spring 54. The other end of the compressed gas passage 61 is opened to the bore 47 at a position wherein the opening 63 of the passage 61 is between the pair of lands on the valve spool 49 when the valve spool 49 is in the uppermost position but blocked by one of the lands when the valve spool 49 is shifted to an intermediate position.

The rear end plate 14 is further formed with inlet pressure passages 64*a* and 64*b* which are in communication with the inlet passage 31. The passages 64*a* 64*b* are opened to the bore 47 at the opposite sides of the land on the valve spool 49 adjacent to the bellows 50 when the valve spool 49 is in the intermediate position shown in FIG. 8. A communicating passage 67 is formed between the bores 47 and 48. The passage 67 is opened at one end 65 to the bore 47 at a position below the opening 63 of the passage 61. The other end 66 of the passage 67 is opened to the bore 48 at a position where the spring 54 is located.

Figure 10:
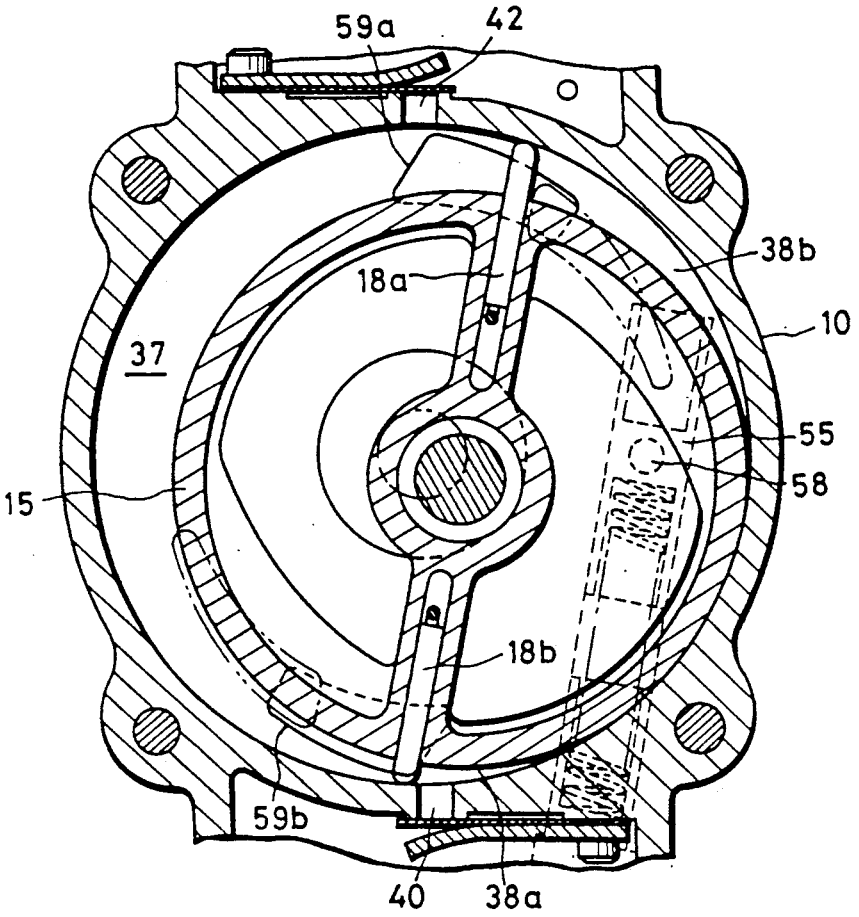
FIG. 10 is a sectional view similar to FIG. 2 showing the relationship between the vanes and the bypass port when the auxilliary plate driving piston is in the uppermost position.

The cooling medium is at a high pressure under the influence of the ambient temperature when the cooling system is started. The gas pressure prevails both in the inlet and outlet sides. The gas pressure is introduced into the bore 47 through the passage 64*b* and overcomes the atmospheric pressure in the bellows 50. Thus, the bellows 50 is compressed to shift the valve spool 49 downwards. The opening 63 of the passage 61 is therefore closed by the land on the valve spool 49 and the opening 65 of the communication passage 67 is opened. The inlet pressure is therefore introduced into the bore 48 to assist the action of the spring 54. As the result, the driving piston 55 is shifted upwards so that the auxilliary plate 13 is rotated counterclockwise in the plane of FIG. 8 until the driving piston 55 abuts the closed end of the bore 48. This position of the auxilliary plate 13 is shown in FIG. 10. In this position of the auxilliary plate 13, the vanes 18*a* and 18*b* bridge the bypass ports 59*a* and 59*b*, respectively.

Figure 11:
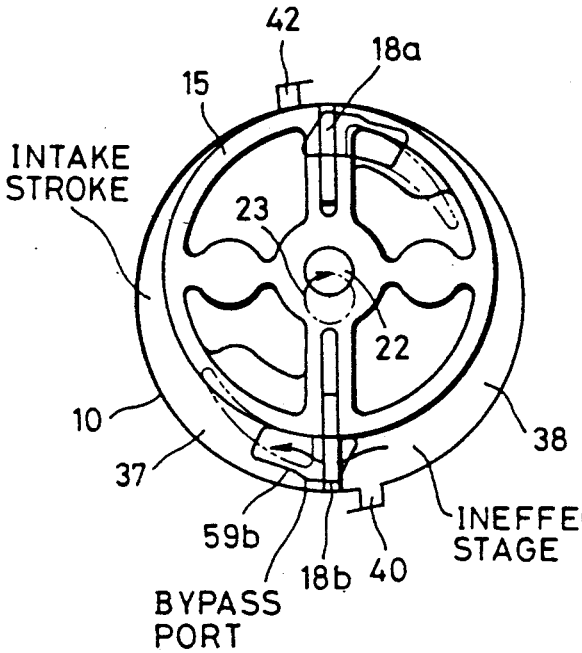
FIGS. 11 (*a*), (*b*), (*c*) and (*d*) are views similar to FIGS. 7 (*a*), (*b*), (*c*) and (*d*) but showing the operation when the compressor stroke is being changed.
Figure 11:
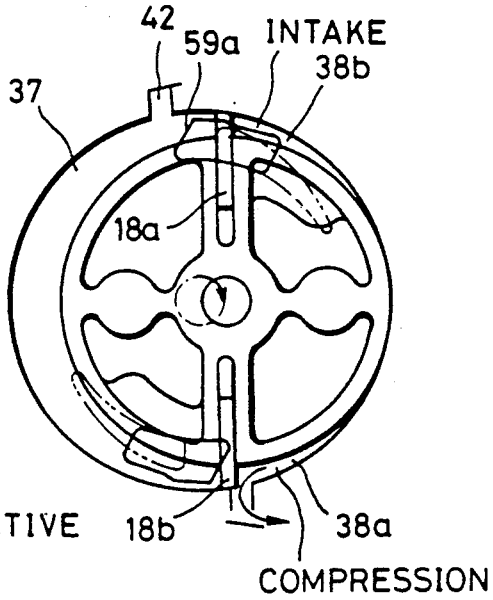
Figure 11:
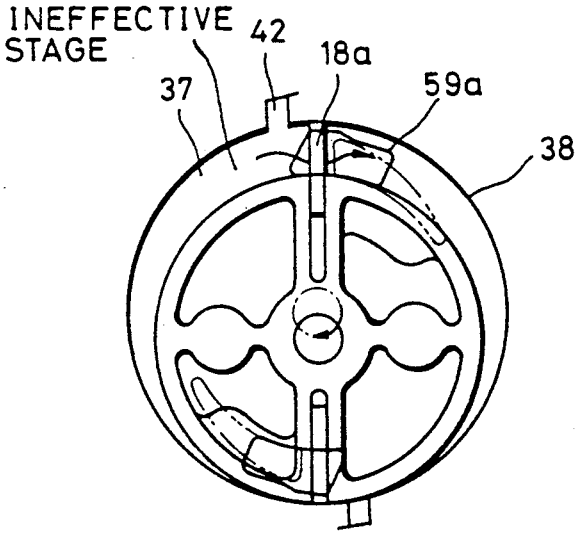
Figure 11:
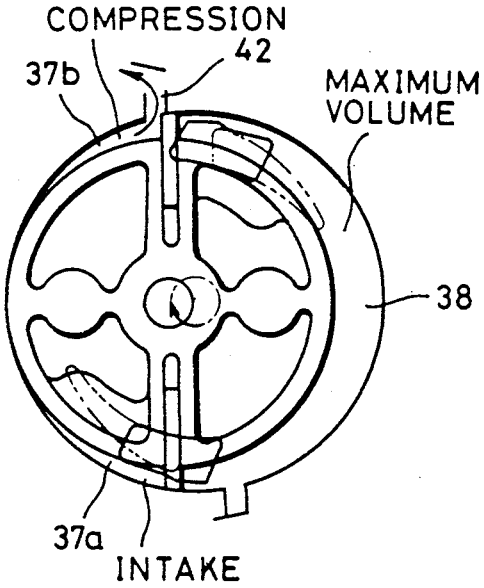

The operation of the compressor with the position of the auxilliary plate 13 shown in FIG. 10 is illustrated in FIGS. 11 (*a*), (*b*), (*c*) and (*d*). When the direction of offset of the eccentric portion 22 of the crankshaft 21 is as shown in FIG. 11 (*a*), the vane 18*b* is on the bypass port 59*b* so that the gas in the chamber 38 is bypassed into the chamber 37. Therefore, the gas in the working chamber 38 will not be compressed. The compressor is therefore in an ineffective stage. When the crankshaft 21 is rotated 90° from the position shown in FIG. 11 (*a*) to the position shown in FIG. 11 (*b*), the vane 18*b* is moved away from the bypass port 59*b* so that the gas in the sub-chamber 38*a* is compressed as the crankshaft rotates. The compressed gas in the sub-chamber 38*a* is then discharged through the outlet port 40. The sub-chamber 38*b* is in the intake stroke. The working chamber 37 possesses the maximum volume so that it is at the end of the intake stroke.

As the crankshaft 21 further rotates to the position shown by FIG. 11 (*c*), the vane 18*a* comes on the bypass port 59*a* so that the gas in the working chamber 37 is bypassed to the working chamber 38. When the crankshaft 21 is further rotated to the position shown in FIG. 11 (*d*), the gas in the sub-chamber 37*b* is compressed and discharged through the outlet port 42. The sub-chamber 37*b* is in the intake stroke. The working chamber 38 possesses the maximum volume so that it is at the end of the intake stroke. It will be understood that with the position of the auxilliary plate 13 shown in FIG. 10 the capacity of the compressor is smaller than that when the plate 13 is in the position shown in FIGS. 2 through 5.

Figure 12:
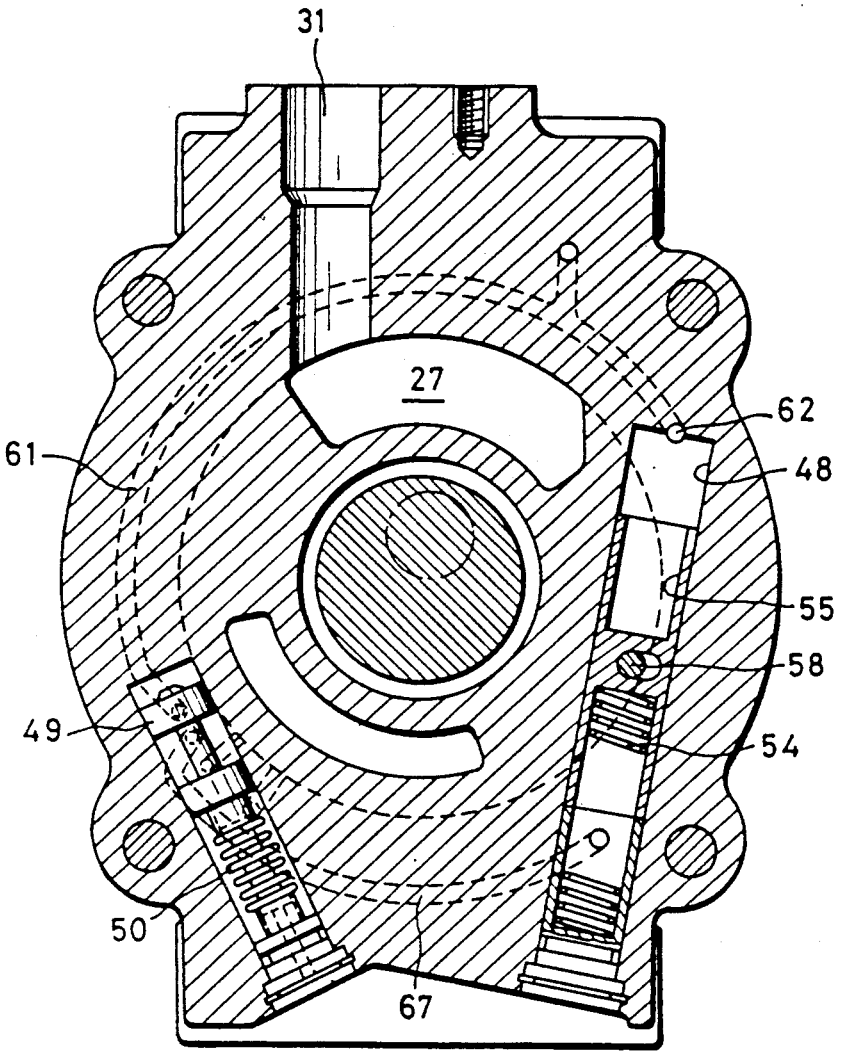
FIG. 12 is a sectional view similar to FIG. 8 but showing the driving piston in the maximum stroke position.

The compressor is thus started with this small capacity so that it can maintain the pressure in the evaporator to a required level. It is therefore possible to maintain the intake gas flow to a required level. As the outlet pressure increases, the pressure introduced into the bore 48 through the opening 62 overcomes the action of the spring 54 to shift the driving piston 55 downwards as shown in FIG. 12. The auxilliary plate 13 is therefore rotated clockwise to increase the capacity of the compressor.

Figure 13:
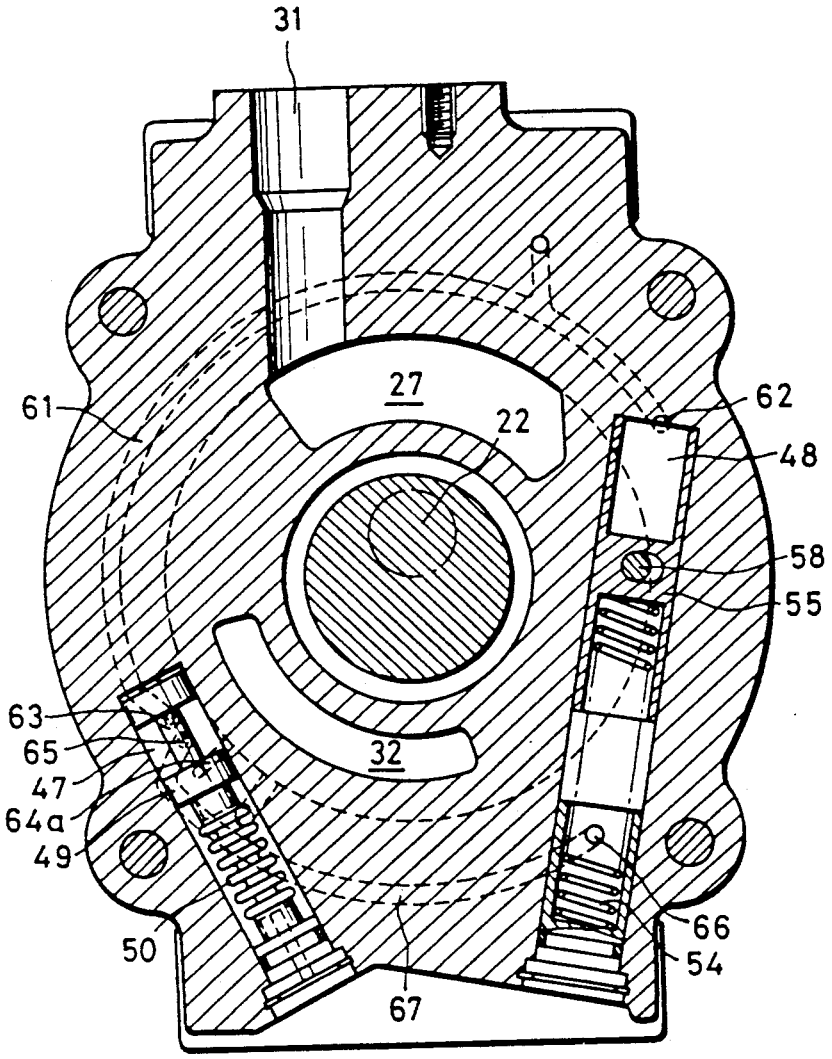
FIG. 13 is a sectional view showing the driving piston in the minimum stroke position.

As the temperature in the compartment decreases, the inlet pressure tends to decrease. Therefore, the pressure introduced into the bore 37 through the passage 64*b* decreases to allow the bellows 50 to expand. The valve spool 49 is then shifted upwards to the position shown in FIG. 13. In this position, the passage 64*a* is closed by the valve spool 49 and the opening 63 is communicated with the opening 65. As the result, the outlet pressure is introduced through the passage 67 into the bore 48 to make the driving piston 55 move upwards under the influence of the spring 54. Thus, the capacity of the compressor is decreased.

Figure 14:
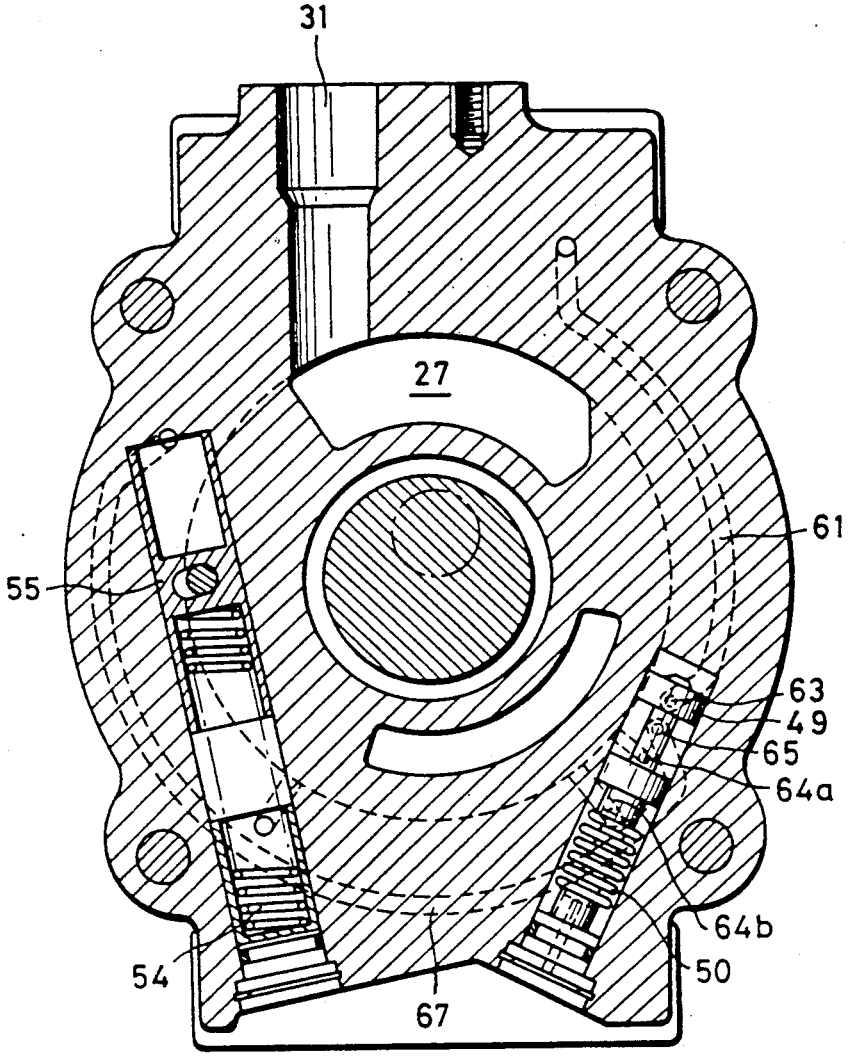
FIG. 14 is a sectional view similar to FIG. 8 but showing another embodiment.
Figure 15:
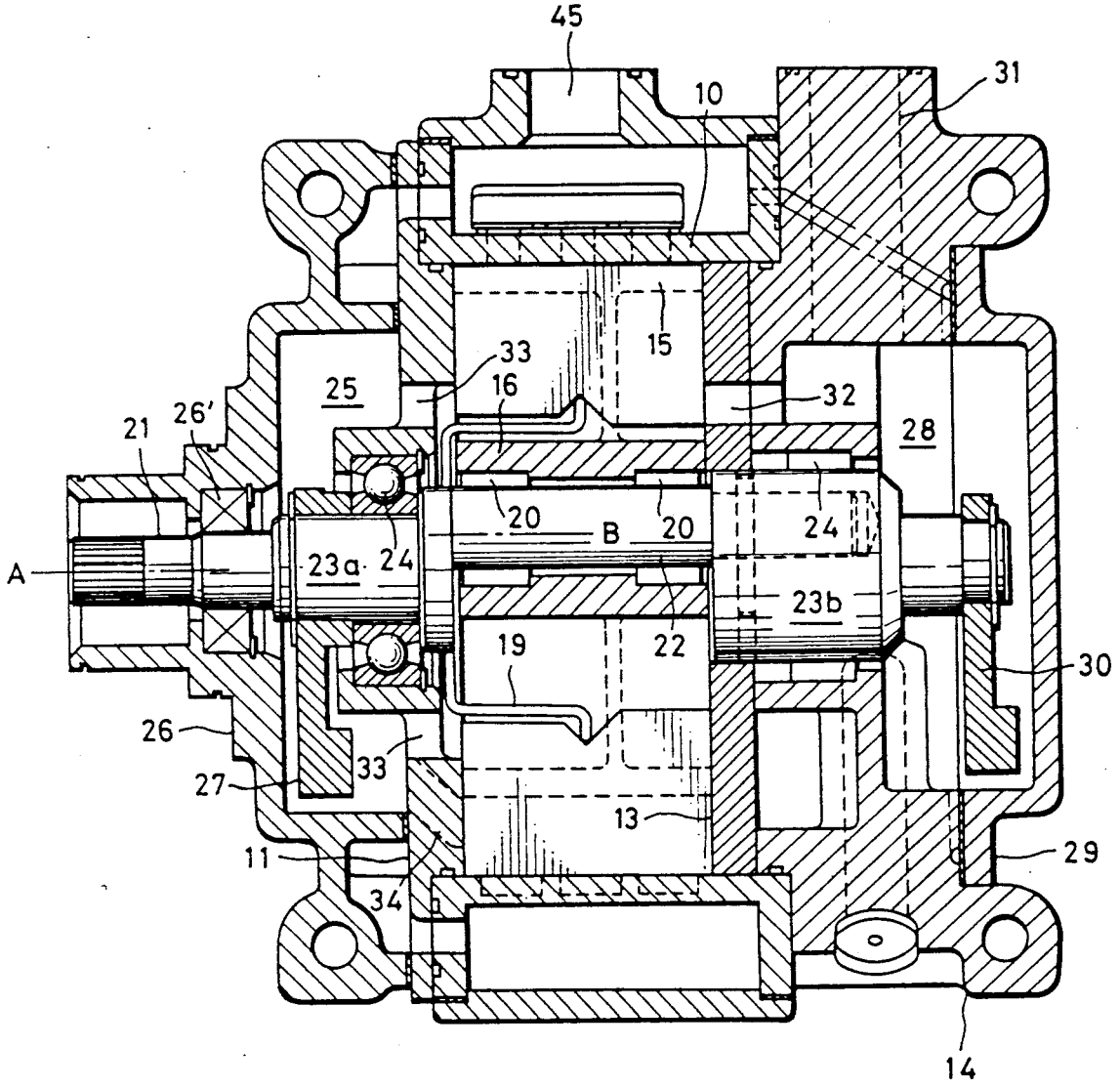
FIG. 15 is a longitudinal sectional view of a compressor in accordance with a further embodiment of the present invention.

FIG. 14 shows another embodiment of the present invention. In this embodiment, the communication passage 67 is opened to the bore 48 at the upper end portion and the inlet gas pressure is applied to the driving piston 55 in the direction of assisting the spring 54. With this arrangement, the compressor is started with the maximum capacity.

Referring to FIGS. 15 through 18, the embodiment shown therein is substantially the same in structure as that of the embodiment previously described so that detailed description of the structure will be omitted. In this embodiment, corresponding parts will be shown by the same reference characters as in the previous embodiment.

Figure 16:
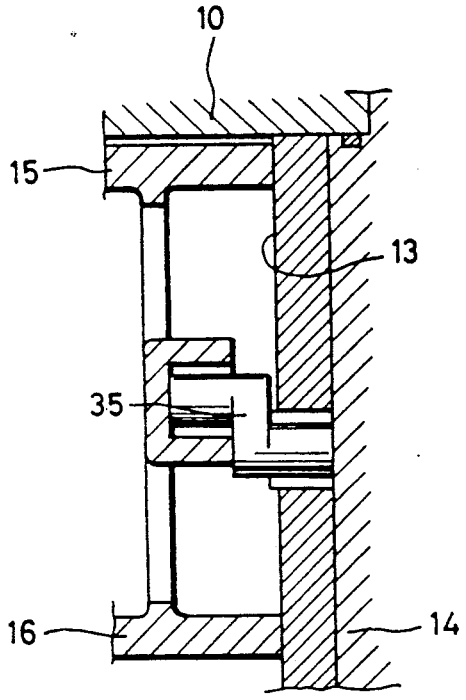
FIG. 16 is a fragmentary sectional view showing the link mechanism for the rotor.
Figure 17:
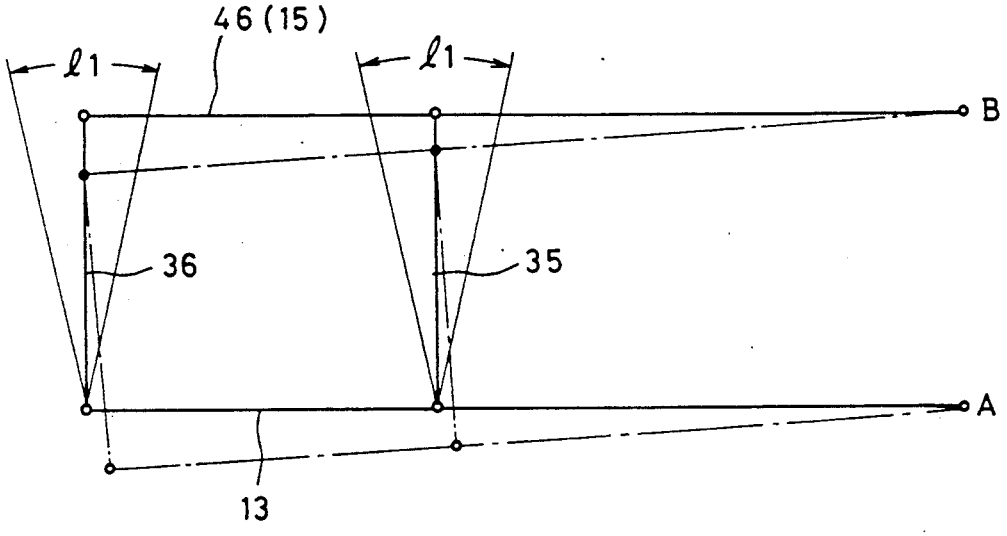
FIG. 17 is a diagrammatical illustration showing the operation of the link mechanism.
Figure 18:
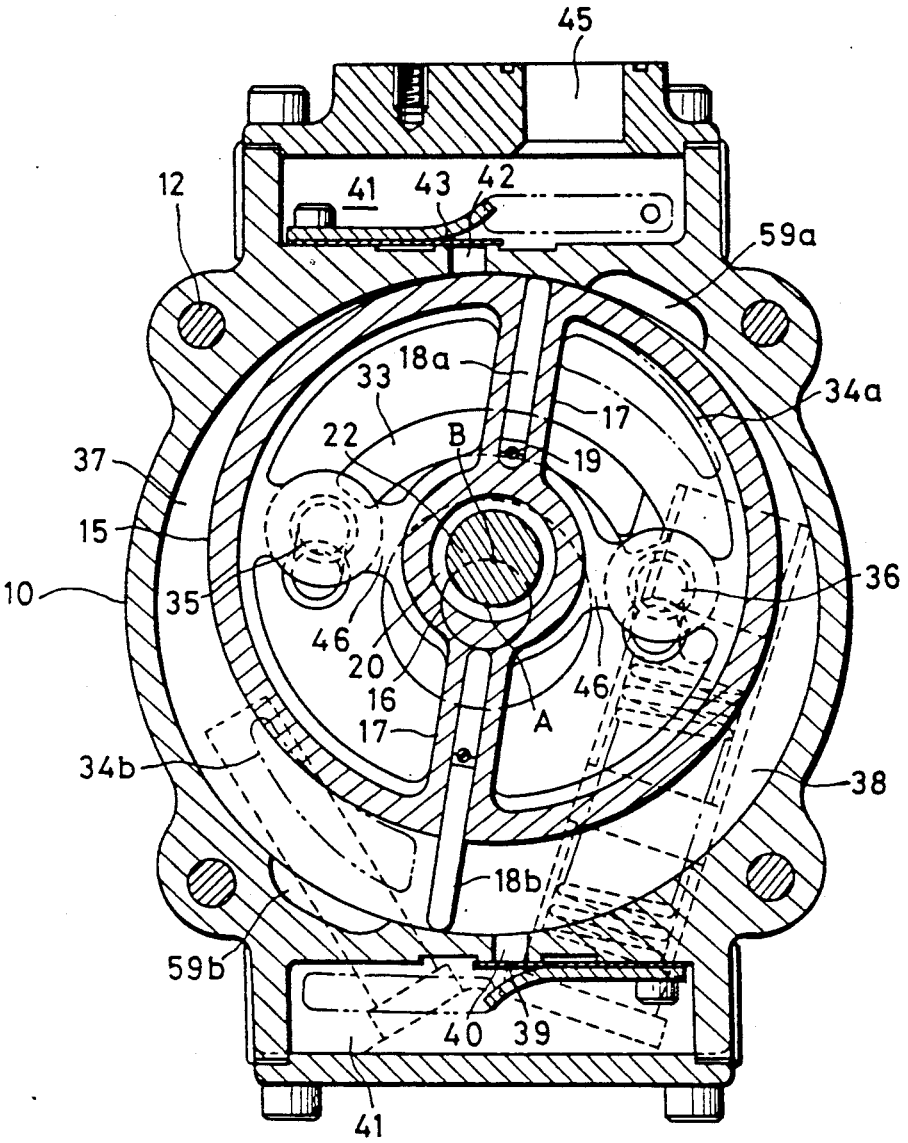
FIGS. 18 through 20 ar cross-sectional views showing the rotor in different positions.
Figure 19:
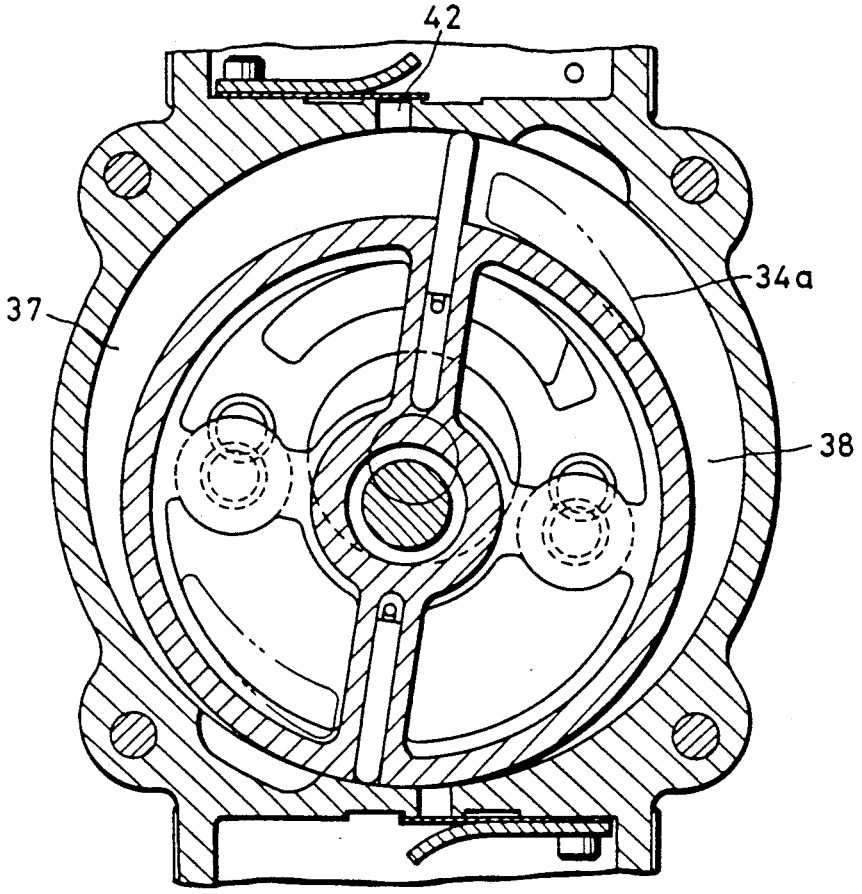
Figure 20:
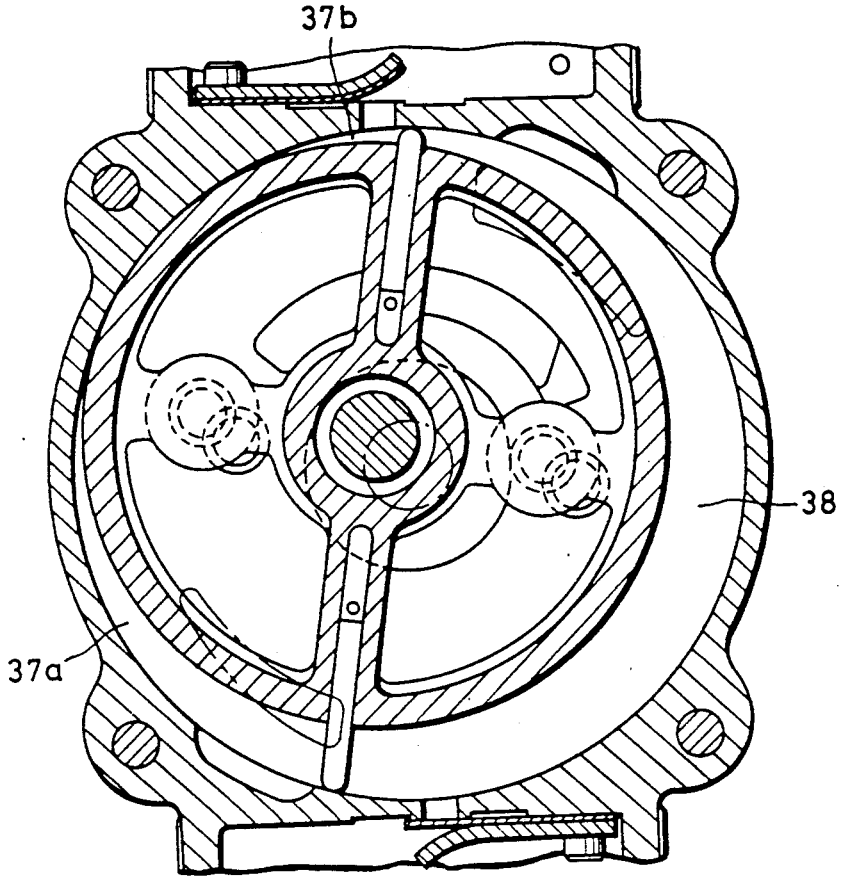
Figure 22:
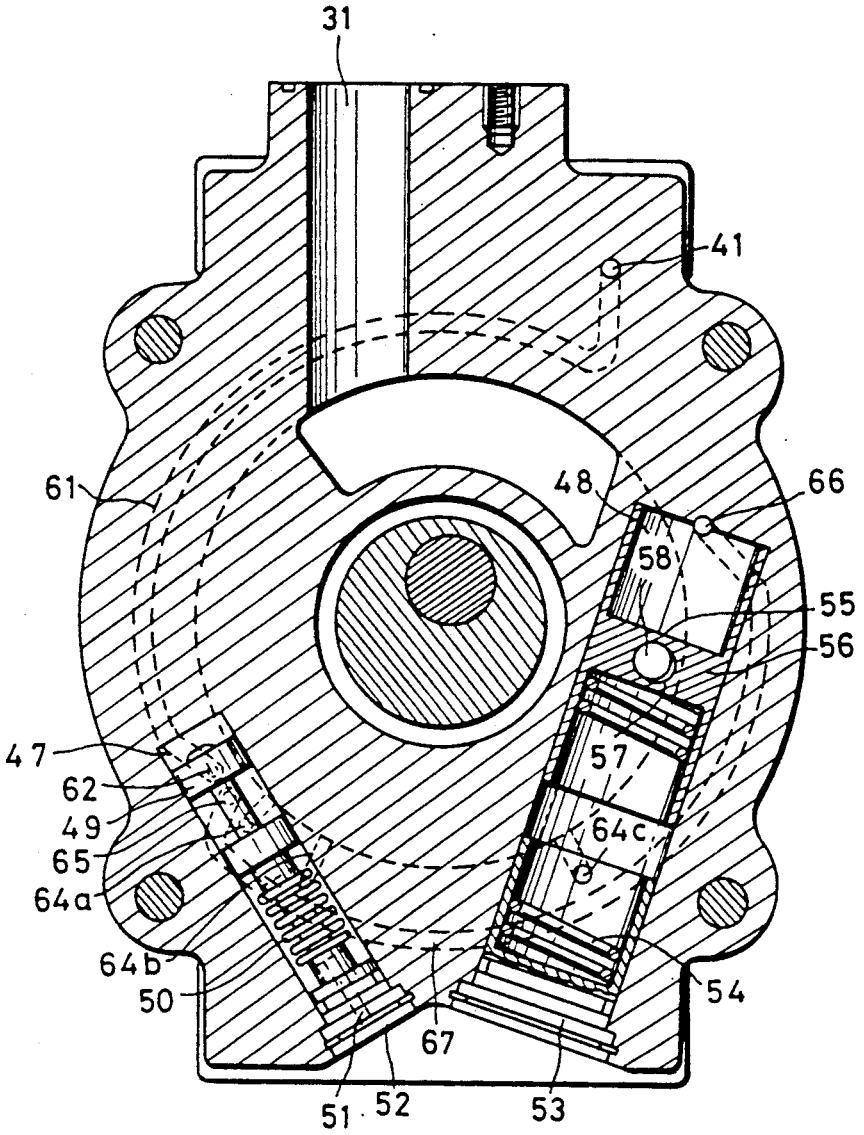
FIG. 22 is a sectional view similar to FIG. 8 showing the mechanism for actuating the auxilliary plate.
Figure 23:
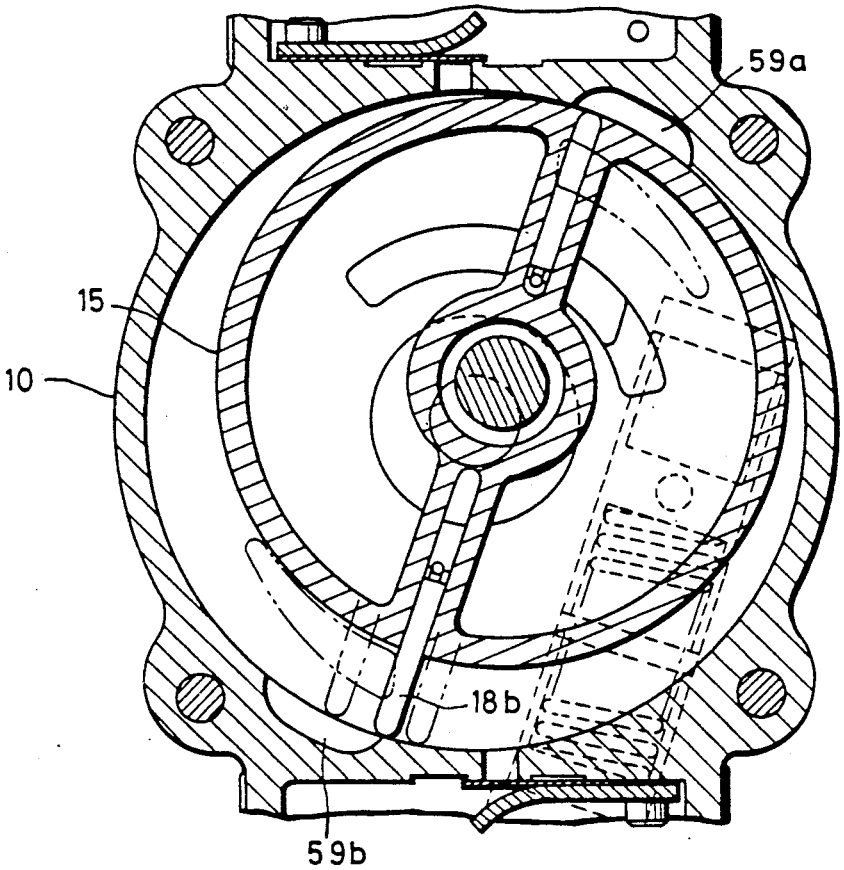
FIG. 23 is sectional view showing the rotor in 50% stroke position.
Figure 24:
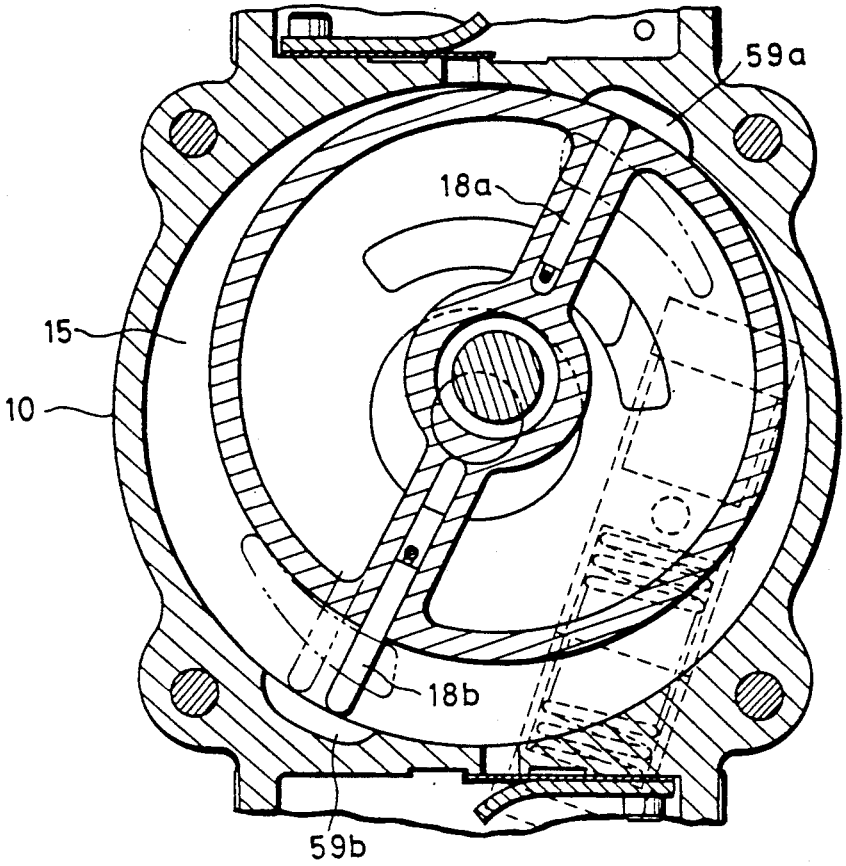
FIG. 24 is a sectional view showing the rotor in 0% stroke position.
Figure 25:
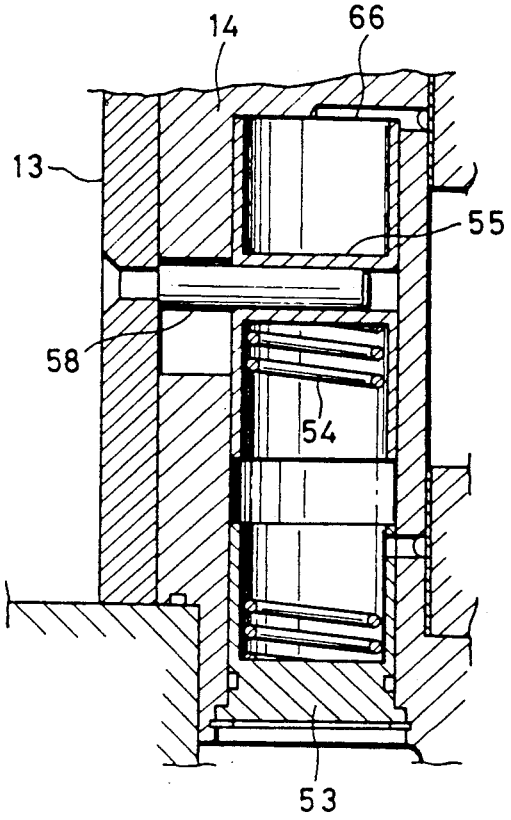
FIG. 25 is a sectional view showing the relationship between the auxilliary plate and the driving piston.

The structure shown in FIGS. 15 through 18 is different from the previously described structure in that the bypass ports 59*a* and 59*b* are formed on the inner wall surface of the cylinder 10 as shown in FIG. 18. A pair of links 35 and 36 are provided as in the previous embodiment. However, in this embodiment, one end of each of the links 35 and 36 is engaged with a recess formed in the auxilliary plate 13 as shown in FIG. 16. FIG. 17 shows the parallelogram formed by the links 35 and 36. In one position of the auxilliary plate 13, the links 35 and 36 are parallel with the direction of offset A-B of the eccentric portion 22 of the crankshaft 21 as shown by solid lines in FIG. 17. With this position, the rotor 15 is oscillated within the angular range $l_1$ in response to a rotation of the crankshaft 21 as shown in FIG. 17. When the auxilliary plate 13 is rotated, the links 35 and 36 are shifted to positions wherein they are not in parallel with the direction of offset A-B of the eccentric portion 22 of the crankshaft 21 as shown by dotted lines in FIG. 17. Then, the angular range of the movement of the rotor 15 is varied. In the illustrated embodiment, the design is such that when the links 35 and 36 are in parallel with the direction of offset A-B, the vanes 18*a* and 18*b* are moved between the outlet ports 40 and 42 and the bypass ports 59*b* and 59*a*, respectively. When the auxilliary plate 13 is rotated so that the links 35 and 36 are located as shown by dotted lines in FIG. 17, the vanes 18*a* and 18*b* can move to positions wherein the working chambers 37 and 38 are bridges by the bypass ports 59*a* and 59*b*, respectively. FIGS. 22 and 25 show the mechanism for angularly actuating the auxilliary plate 13 in response to the inlet and outlet pressure. The mechanism is substantially the same as that in the previous embodiment.

Figure 21:
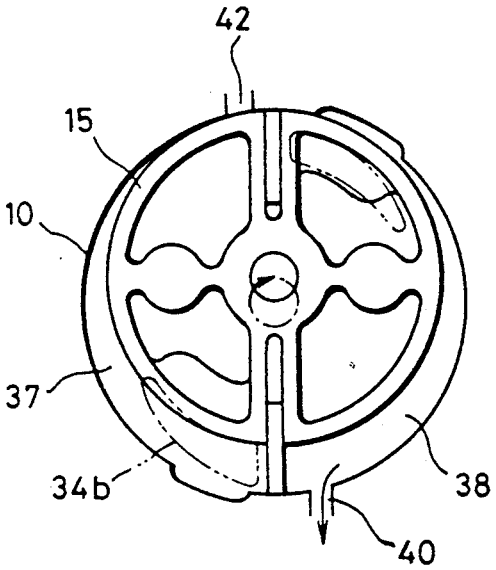
FIGS. 21 (*a*), (*b*), (*c*) and (*d*) are diagrammatical illustrations showing the operation of the rotor.
Figure 21:
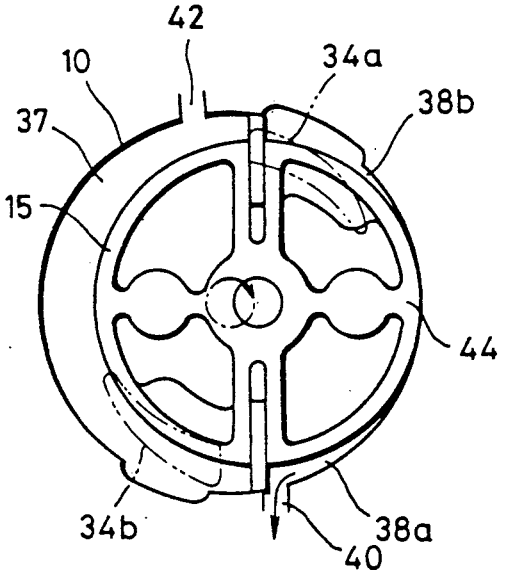
Figure 21:
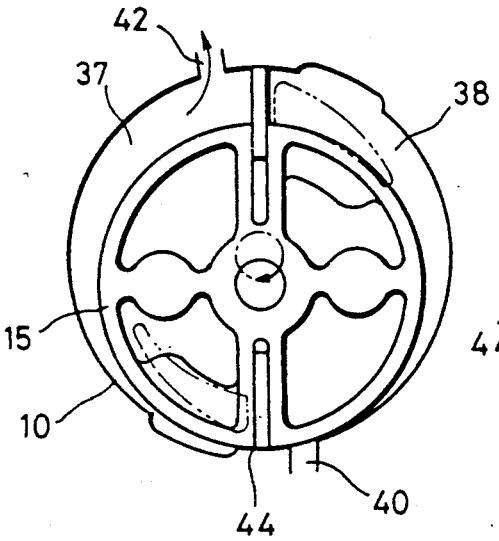
Figure 21:
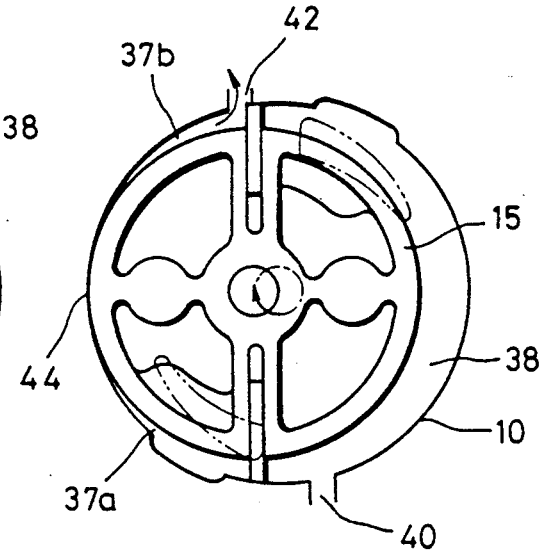
Figure 26:
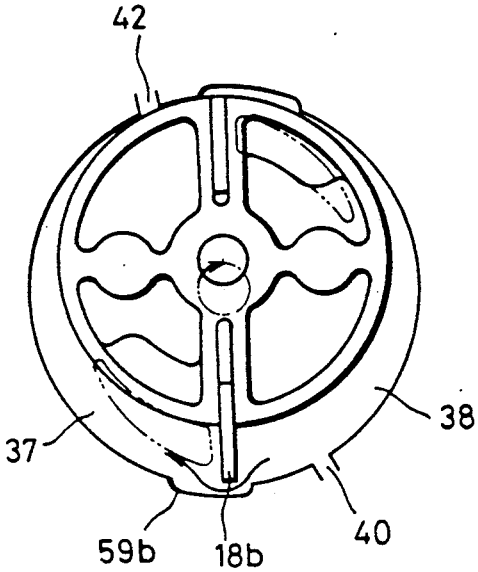
FIG. 26 (*a*), (*b*), (*c*) and (*d*) are diagrammatical illustrations showing the operation when the compressor stroke is being changed.
Figure 26:
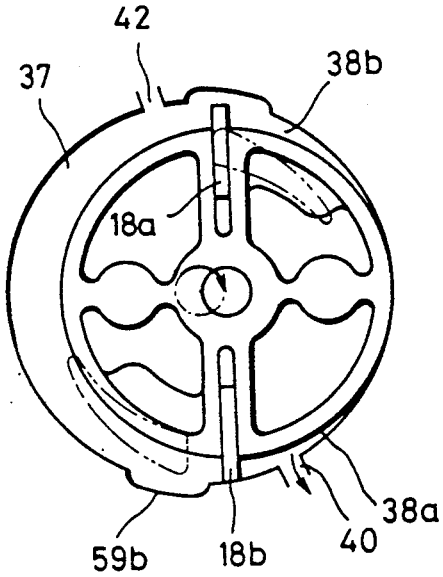
Figure 26:
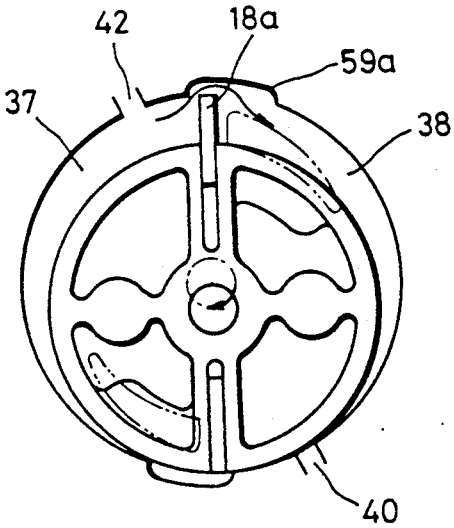
Figure 26:
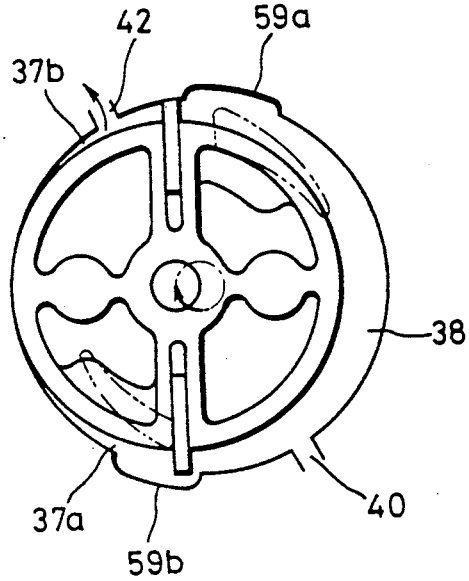

FIGS. 18 through 21, 23 and 24 show the operation of the compressor in this embodiment. Under a full load operation, the vanes 18*a* and 18*b* are reciprocated on the parts of the inner wall surface of the cylinder 10 between the outlet ports 42 and 40 and the bypass ports 59*a* and 59*b*, respectively. FIGS. 21 (*a*), (*b*), (*c*) and (*d*) show the sequence of operation under the full load. The auxilliary plate 13 is rotated under the influence of the inlet and outlet pressures. The operation under this circumstance is shown in FIGS. 26 (*a*), (*b*), (*c*) and (*d*).

The invention has thus been shown and described with reference to preferable embodiments, however, it should be noted that the invention is in no way limited to the details of the illustrated structures but changes and modifcactions may be made without departing from the scope of the appended claims.

We claim:

1. A compressor including a cylinder having a cylindrical inner wall surface; a rotor supported by eccentric means in said cylinder; at least a pair of vanes carried at diametrically opposed positions by said rotor to extend in a radial direction, each of said vanes having a radially outward edge which is in sliding contact with said inner wall surface of said cylinder; end plates secured to said cylinder at axially opposite ends thereof; link means extending between said rotor and at least one of said end plates so that said rotor conducts an orbital movement in response to a rotation of said eccentric means, whereby each vane moves in an angular range of less than 360°; said inner wall surface of the cylinder, said vanes, and axially facing surfaces of said end plates defining working chambers whose volumes are variable in response to said orbital movement of said rotor; inlet and outlet port means for said working chambers; at least one bypass port provided on at least one of said axially facing surfaces and is situated adjacent a respective one of said vanes; and stroke changing means for adjusting the circumferential positional relationship between said at least one bypass port and said angular range of movement of said respective vane, so that in one position of adjustment said at least one bypass port lies outside of said angular range of movement of said respective vane, and in another position of adjustment said at least one bypass port overlaps said angular range of movement of said respective vane to change the effective stroke of the compressor.

2. A compressor in accordance with claim 1, wherein said stroke changing means is operable to displace the circumferential position of said at least one bypass port.

3. A compressor in accordance with claim 2, wherein one of said end plates includes auxiliary plate means forming said axially facing surface of said one end plate, said at least one bypass port being disposed in said last-named surface, said auxiliary plate means being rotatable, said stroke changing means including means for rotating said auxiliary plate means relative to said cylinder to displace the circumferential position of said at least one bypass port.

4. A compressor in accordance with claim 3 in which said stroke changing means includes actuating means for rotating said auxiliary plate means in response to an outlet pressure of the compressor.

5. A compressor in accordance with claim 3 in which said stroke changing means includes actuating means for rotating said auxilliary plate means in response to an inlet pressure and an outlet pressure of the compressor.

6. A compressor in accordance with claim 5 in which said actuating means includes a driving piston having spring bias means for forcing said piston in one axial direction, first pressure chamber provided in one side of the piston opposite to said spring bias means, second pressure chamber means provided in the other side of the piston, passage means for introducing the outlet pressure into said first pressure chamber, valve means for introducing said inlet pressure into said second chamber when the inlet pressure is higher than the atmospheric pressure.

7. A compressor in accordance with claim 1, wherein said stroke changing means is operable to displace the circumferential position of said angular range of movement of said respective vane.

8. A compressor in accordance with claim 7, wherein one of said end plates includes auxiliary plate means forming said axially facing surface of said one end plate, said auxiliary plate means being rotatable, said link means extending between said rotor and said auxiliary plate means, said stroke changing means including means for rotating said auxiliary plate means to displace the circumferential position of said angular range of movement of said respective vane.

* * * * *